US005371995A

United States Patent [19]

Guttinger et al.

[11] Patent Number: 5,371,995

[45] Date of Patent: Dec. 13, 1994

[54] HESITATING CARTON LOADING MACHINE

[75] Inventors: Peter Guttinger, Milton; Istvan Ungar, Mississauga, both of Canada

[73] Assignee: H. J. Langen & Sons, Inc., Mississauga, Canada

[21] Appl. No.: 65,137

[22] Filed: May 20, 1993

[51] Int. Cl.[5] ..... B65B 5/06; B65B 43/52; B65G 15/00

[52] U.S. Cl. ..... 53/251; 53/257; 53/249; 198/343.1

[58] Field of Search ..... 53/250, 249, 251, 252, 53/247, 257, 260, 255, 235, 473; 198/343.1, 343.2, 465.1

[56] References Cited

U.S. PATENT DOCUMENTS

| | | | |
|---|---|---|---|
| 3,125,204 | 3/1964 | Loven | 198/465.2 |
| 3,204,756 | 9/1965 | Lesch | 198/465.1 |
| 3,370,549 | 2/1968 | Livingston | 198/465.1 |
| 3,645,375 | 2/1972 | Gelzer | 198/345.3 |
| 4,203,271 | 5/1980 | Raudat | 53/250 |
| 4,461,379 | 7/1984 | Papp | 198/465.1 |
| 4,625,857 | 12/1986 | Kuehl | 198/465.1 |
| 4,653,972 | 3/1987 | Lewis | 198/343.2 |
| 4,793,762 | 12/1988 | Münch et al. | 53/250 X |
| 5,056,298 | 10/1991 | Deadmond | 53/251 X |
| 5,060,367 | 10/1991 | Vandevoorde | 198/343.2 |
| 5,101,957 | 4/1992 | Schiek | 53/251 X |
| 5,226,524 | 7/1993 | Guttinger et al. | 198/343.2 |

*Primary Examiner*—James F. Coan

*Attorney, Agent, or Firm*—Fred A. Keire; George B. Snyder

[57] ABSTRACT

A carton loading system has a carton carrier movable along a carton carrier support track driven by a continuous conveyor. The continuous conveyor has a first path segment in which the continuous conveyor drives the carton carrier along the track while a carton is placed into the carton carrier from a carton storage magazine by a carton transfer device. The continuous conveyor also has a second segment with a first portion arranged such that the conveyor is disengaged from the carton carrier to allow the carrier to a stop, permitting loading of the carton. At the loading station an accumulator may be positioned to load the carton. The second portion of the second segment is such that conveyor re-engages the carton carrier so that the carton carrier moves again along the track. The carton may be discharged from the carton carrier while the carton carrier moves along the track. The system may be adapted to provide for adjustable components such that cartons of differing depths can be accommodated.

9 Claims, 6 Drawing Sheets

HESITATING CARTON LOADING MACHINE

FIELD OF INVENTION

This invention relates to carton loading systems, in particular, a carton loading system having a continuous conveyor.

BACKGROUND OF THE INVENTION

Carton loading systems are well known and generally have a conveyor that drives a series of carton carriers along a track from a first station where a carton is erected and placed in a carton carrier, to a second station where product is loaded into the carton held in the carton carrier, the carton thereafter being sealed, to a third station where the carton containing the loaded carton is discharged from the carton carrier.

In prior art systems the conveyor which drove the carton carrier along a track would operate intermittently (i.e. in other words it would be indexed from one position to the next, remaining stationary for a period of time at discrete intervals). One problem with this system is that the speed at which it can operate is limited. Furthermore, the system is noisy and there is considerable wear on the specific components of the system.

Although it is easier to design components for a system wherein the operations at the various stations take place when the carton carriers are stationary, due to the aforementioned problems there has been a desire to make the operation of the components in the carton loading system continuous.

Carton transfer devices have already been developed which can operate continuously (i.e. a carton can be removed from a carton storage magazine to be erected and placed in a carton carrier while it moving along a track driven by a continuous conveyor). Such an apparatus is disclosed in U.S. Pat. No. 3,937,458 which issued Feb. 10, 1976 and assigned to H. J. Langen & Sons Limited.

Also, various devices have been developed to discharge a loaded carton from a carton carrier while the carton and carton carrier are moving. Such a device would typically discharge the carton laterally from the carton carrier.

Although devices have been developed to provide for continuous placement and erection of a carton in a carton carrier, and to discharge a loaded carton from a carton carrier in a continuous manner, there is a certain inherent conflict. This is because it is usually desirable in the loading operation of the carton, to have the carton stationary relative to the loading device. This has posed design problems given the desire to have a conveyor that operates continuously.

One solution has been to have the continuous conveyor engage the carton carriers by a clutch mechanism. When the carton carrier, carrying an erected carton arrives at the loading station, an abutment device contacts the carton carrier to temporarily prevent movement of the carton carrier along the track. The clutch mechanism between the carton carrier and the continuous conveyor slips as the abutment device overrides the continuous conveyor. However, this type of loading station has considerable disadvantages. There will be substantial wear on the clutch mechanism when a carton carrier is stopped because the clutch mechanism does not disengage from the carton carrier but rather just slips. Furthermore, both the motion of bringing the carton carrier to a stop at the loading station and also the motion of the carton carrier as it moves away from the loading station will be erratic and will depend upon the operation of the clutch mechanism.

In order to overcome the aforementioned disadvantages of stopping the carton carrier at the station, one solution which has been generally adopted is to provide a second continuous conveyor device which moves buckets holding the product to be loaded into the carton. The second product conveyor is typically set up to run parallel and adjacent to the carton carrier conveyor and will operate at the same speed. Thus, buckets carrying product can be aligned and moved in synchronization with the carton carriers. Thus, there will be no relative movement of the bucket carrying the product relative to the carton carried by the carton carrier, and product can be laterally discharged from the bucket into the carton without having to stop the continuous conveyor and/or the carton carrier.

The problem with this system is that it requires a separate second conveyor device that will extend longitudinally parallel to the carton conveyor for some distance. Not only does such a device result in added expense but it will occupy a considerable amount of floor space, which in many commercial situations is very undesirable.

A further problem associated with carton loading systems is to provide carton carriers which are adaptable to accommodate cartons not only of a different width but also cartons of different depth.

The present invention seeks to overcome the aforementioned disadvantages of the known carton loading systems.

SUMMARY OF INVENTION

According to one aspect of the invention there is provided, a carton loading system comprising: a carton carrier support track adapted to support a carton carrier, the carton carrier movable along the carrier support track and being adapted to receive a carton, and the carton carrier having an engageable means associated therewith; a continuous conveyor carrying at least one engaging element downstream, the engaging element adapted to engage the engageable means of a carton carrier to drive the carton carrier along the carton carrier support track, the continuous conveyor having a conveyor path with a first path segment and a second path segment located downstream of the first path segment, the first path segment being such that an engaging element of the at least one engaging element is carried in engagement with the engageable means in order to drive the carton carrier along the carrier support track, a first portion of the second path segment being such that the engaging element is carried from a position of engagement with the engageable means to a position of disengagement from the engageable means such that the carton carrier may be stopped for a period of time along the carrier support track, a second portion of the second path segment located downstream from the first portion being such that an engaging element of the at least one engaging element is carried to a position of engagement such that the carton carrier may again be driven along the carrier support track; a carton storage means for storing a plurality of cartons; a carton transfer means located in operational proximity of the first path segment for transferring continuously a carton from the carton storage means onto the carton carrier, while the carton carrier is being driven along the carrier support track by an engaging element of the at least one engaging element carried by the continuous conveyor; a product loading means in operational proximity of the second path segment for loading a product into a carton carried by the carton carrier when the carton carrier is at a stationary position; in operation, the continuous conveyor first carrying an engaging element of the at least one engaging element along the first path segment, the engaging element being in engagement with the engageable means and driving the carton carrier along the carrier track and the carton transfer means transferring a carton to a moving carton carrier as the engaging element moves along the first path segment, the continuous conveyor thereafter carrying an engaging element of the at least one engaging element in engagement with the engageable means, from the first path segment to the second path segment whereby the carton carrier is driven further along said carrier track, thereafter said continuous conveyor carrying the engaging element along the first portion of the second path segment from a position of engagement with the engageable means to a position of disengagement from the engageable means such that the carton carrier is stopped at said stationary position for a period of time on said carrier track to permit the product loading means to load product into the carton carried by the carton carrier; thereafter the continuous conveyor carrying an engaging element of the at least one engaging element along the second portion of the second path segment to a position of engagement with the engageable means to drive the carton carrier again along the carrier support track.

According to another aspect of the invention there is provided a carton loading system comprising: first and second carton carrier support tracks each adapted to support first and second carton carriers respectively, each of the first and second carton carriers movable along their respective carrier support track, the first and second carton carriers being aligned on their respective support tracks and being adapted to receive a carton and to permit loading of a carton to be supported by the first and second carton carriers, the first and second carton carriers each having an engageable means associated therewith; a first continuous conveyor carrying at least one engaging element downstream, the engaging element adapted to engage the engageable means of the first carton carrier to drive the first carton carrier along the first carton carrier support track, the first continuous conveyor having a conveyor path with a first path segment and a second path segment located downstream of the first path segment, the first path segment being such that an engaging element of the at least one engaging element is carried in engagement with the engageable means in order to drive the first carton carrier along the first carrier support track, a first portion of the second path segment being such that the engaging element is carried from a position of engagement with the engageable means to a position of disengagement from the engageable means such that the first carton carrier may be stopped for a period of time along the first carrier support track, a second portion of the second path segment located downstream from the first portion being such that an engaging element of the at least one engaging element is carried to a position of engagement such that the first carton carrier may again be driven along the first carrier support track; a second continuous conveyor moving at the same speed as the first continuous conveyor and carrying at least one engaging element downstream, the engaging element adapted to engage the engageable means of the second carton carrier to drive the second carton carrier along the second carton carrier support track in synchronization with the movement of the first carton carrier along the first carton carrier support track, the second continuous conveyor having a conveyor path with a first path segment and a second path segment located downstream of the first path segment, the first path segment being such that an engaging element of the at least one engaging element is carried in engagement with the engageable means in order to drive the second carton carrier along the second carrier support track, a first portion of the second path segment being such that the engaging element is carried from a position of engagement with said engageable means to a position of disengagement from said engageable means such that the second carton carrier may be stopped for a period of time along the second carrier support track that corresponds with the period of time that the first carton carrier may be stopped along the first carton carrier support track; a second portion of the second path segment of said second continuous conveyor path located downstream from the first portion being such that an engaging element of the at least one engaging element is carried to a position of engagement such that the second carton carrier may again be driven along the second carrier support track in synchronization with the movement of the first carton carrier along the first carton carrier support track; a carton storage means for storing a plurality of cartons; a carton transfer means located proximate the first path segments of the first and second continuous conveyors for transferring continuously a carton from the carton storage means onto the first and second carton carriers, while the first and second carton carriers are being driven respectively along the first and second carrier support tracks by engaging elements of the at least one engaging element carried by said first and second continuous conveyors; a product loading means at the second path segment for loading a product into a carton carried by the first and second carton carrier when the first and second carton carriers are at a stationary position; in operation, the first and second continuous conveyors first each carrying engaging element of the at least one engaging element along the first path segments, the engaging elements being in engagement with the engageable means of the first and second carton carrier and driving the first and second carton carriers in synchronization along the first and second carrier tracks respectively and the carton transfer means transferring a carton to moving first and second carton carriers as said engaging elements move along said first path segments, the first and second continuous conveyors thereafter each carrying an engaging element of the at least one engaging element in engagement with the engageable means of the first and second carton carriers, from the first path segment to the second path segment whereby the first and second carton carriers are driven further along the first and second carrier tracks, the first and second continuous conveyors moving the engaging elements along the first portions of the second path segment and carrying the engaging elements from positions of engagement with the engageable means of the first and second carton carriers to positions of disengagement from the engageable means of the first and second carton carriers such that the first and second carton carriers are stopped at the stationary position for a period of time on the first and second carrier tracks to permit the product loading means to load product into the carton carried by the first and second carton carriers, thereafter the first and second continuous conveyors each carrying an engaging element of the at least one engaging element along the second portions of the second path segments to a further position of engagement with the engageable means of the first and second carton carriers to drive the first and second carton carriers again in synchronization along the first and second carrier support tracks.

BRIEF DESCRIPTION OF THE DRAWINGS

The invention will be more clearly understood after reference to the following detailed specification read in conjunction with the drawings describing and illustrating example embodiments of the invention.

DETAILED DESCRIPTION OF THE PREFERRED EMBODIMENTS

Figure 1:
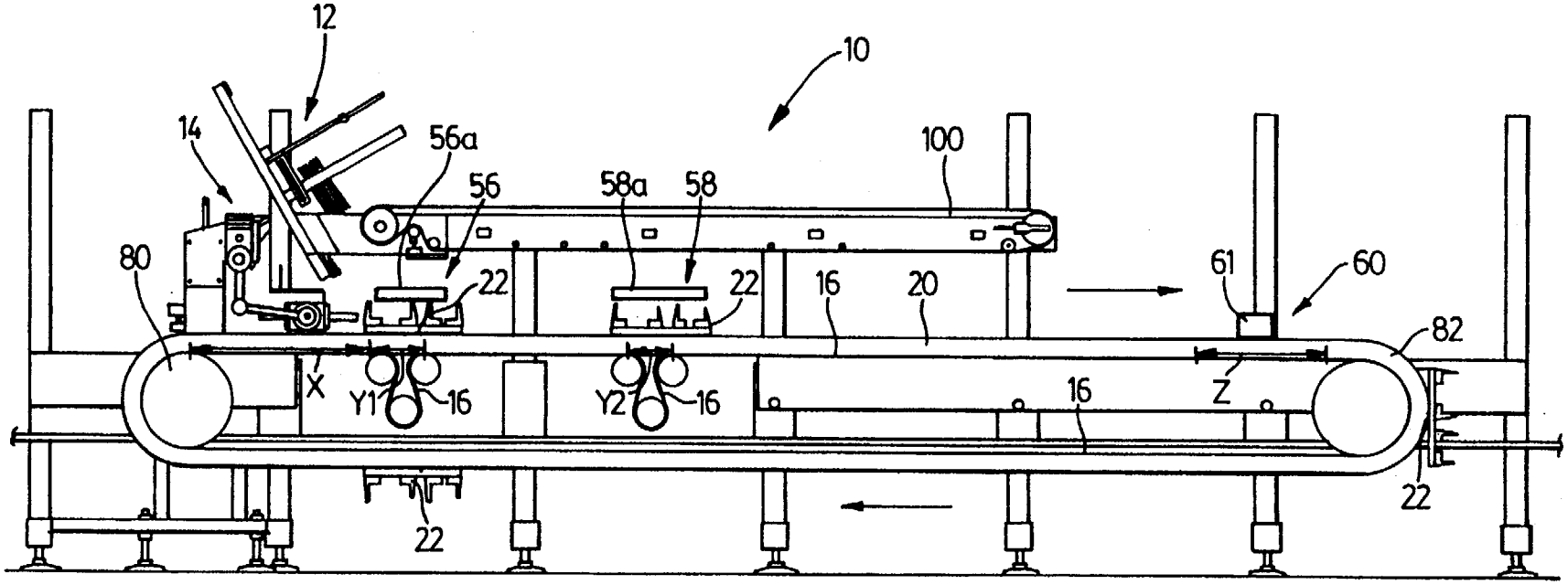
FIG. 1 is a schematic side view of a carton loading system according to one embodiment of the invention.
Figure 2:
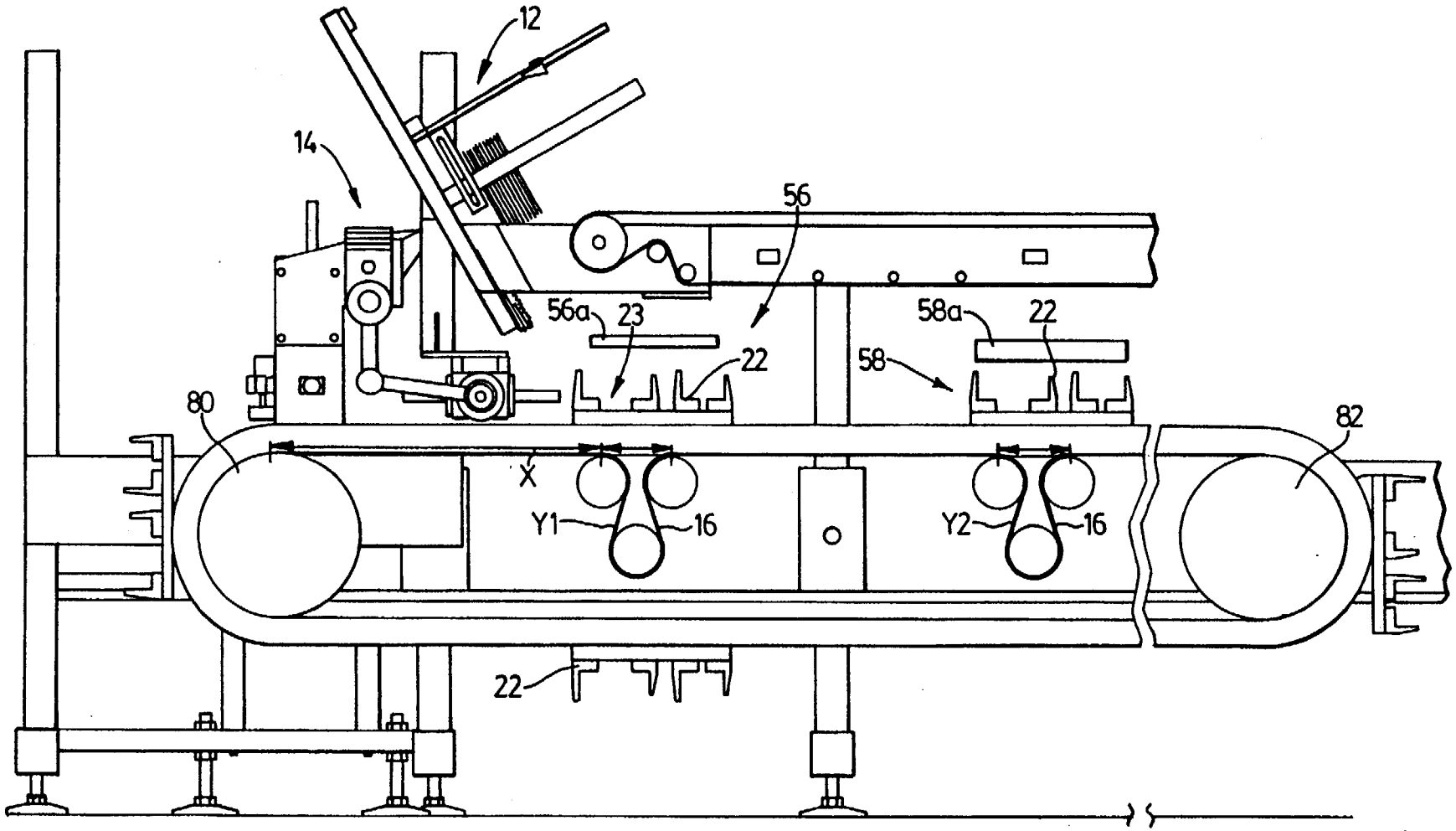
FIG. 2 is an enlarged view of portions of FIG. 1.

The example embodiment shown in FIGS. 1 to 6 of the drawings comprises a carton loading system generally designated 10. Carton loading system 10 has a carton storage device 12 and a carton transfer device 14. Carton loading system also includes a continuous conveyor 16 carrying a plurality of engaging elements 18. Further, the carton loading system includes a carton carrier support track which is adapted to support a plurality of carton carriers 22.

Figure 4:
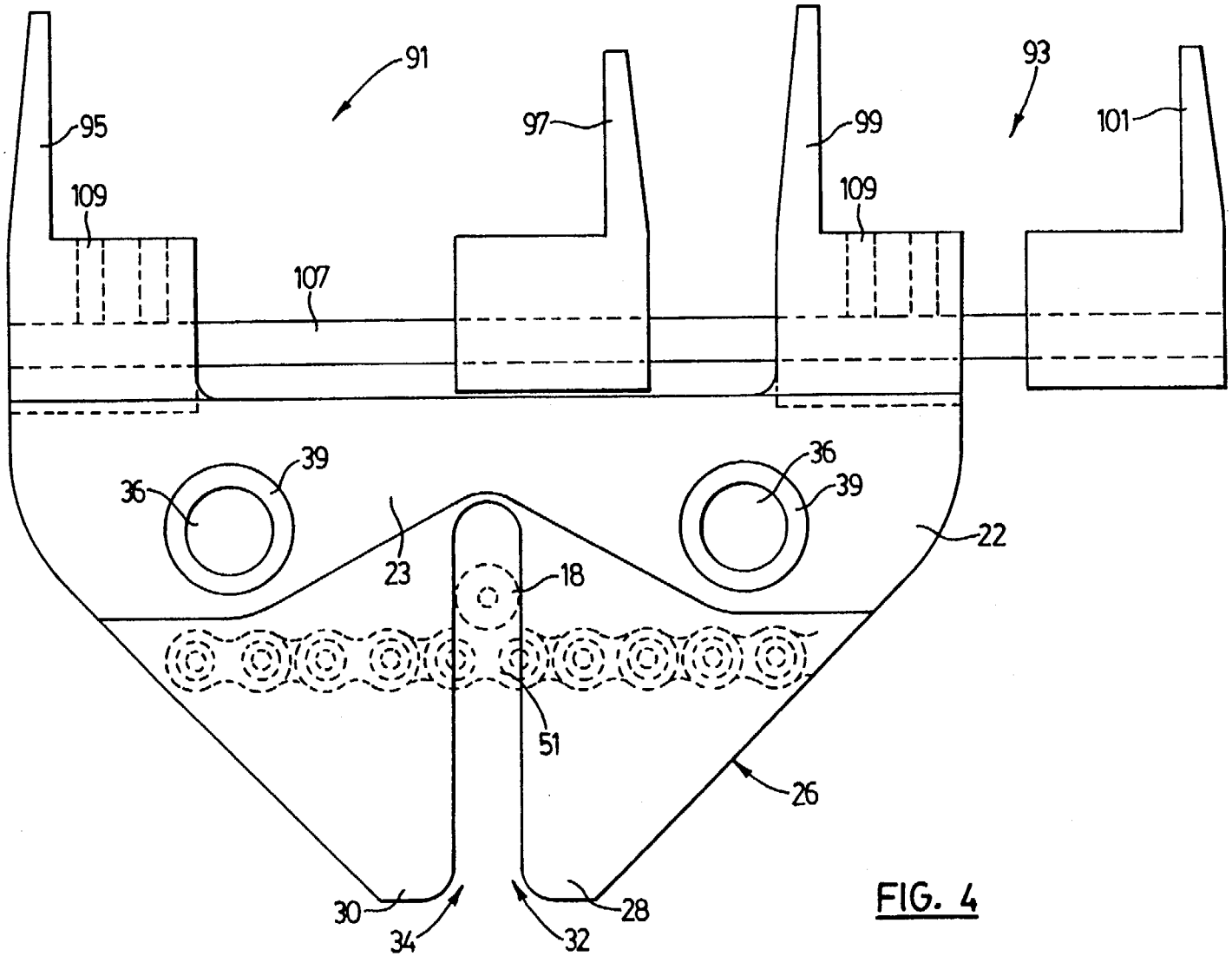
FIG. 4 is a side view of a carton carrier of FIG. 2.

As shown in FIG. 4, a carton carrier 22 has a body portion 23 having an integrally formed depending engagable means 24 comprising a cam member 26 having a pair of spaced cam arms 28,30 with a slot 32 provided therebetween. Engaging element 18 which is a cam follower 34 is receivable in slot 32 between cam arms 28,30. In each carton carrier 22, a pair of carton receptacles 91 and 93 are formed by receptacle walls 95,97 and 99, 101 respectively. Receptacle walls 95 and 99 are fixed relative to body 23 and may be integrally formed therewith. All receptacle walls 95,97,99,101 have a pair of longitudinally aligned boreholes 103 and 105 that are adapted to receive shafts 107 therethrough. Threaded vertical holes 109 are adapted to receive screws (not shown) to fix the position of shafts 107 relative to walls 95 and 99. The position of walls 97 and 101 relative to shafts 107 is adjustable thus providing for variation in the width of cartons that can be received in the carton receptacles 91,93.

Figure 6:
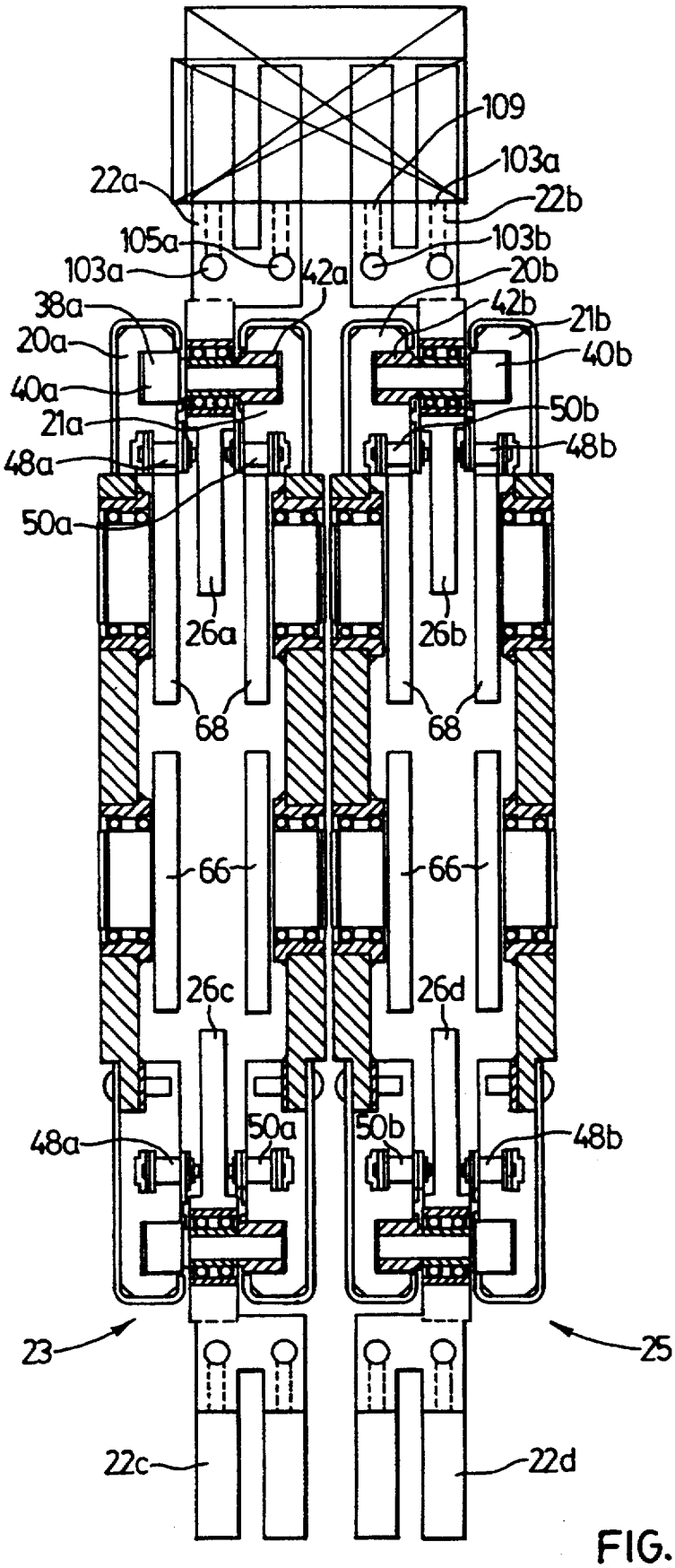
FIG. 6 is a sectional view on a plane defined by line 6—6 in FIG. 2.

Also, as shown in FIGS. 4 and 6, a carton carrier 22 has a pair of bushings 36 passing transversely through body portion 23. Received through each bushing 36 are freely rotatable wheel units 39 having a pair of wheels 40 and 42. Wheel 40 is disposed on the opposite side of body 23 to wheel 42.

Figure 3:
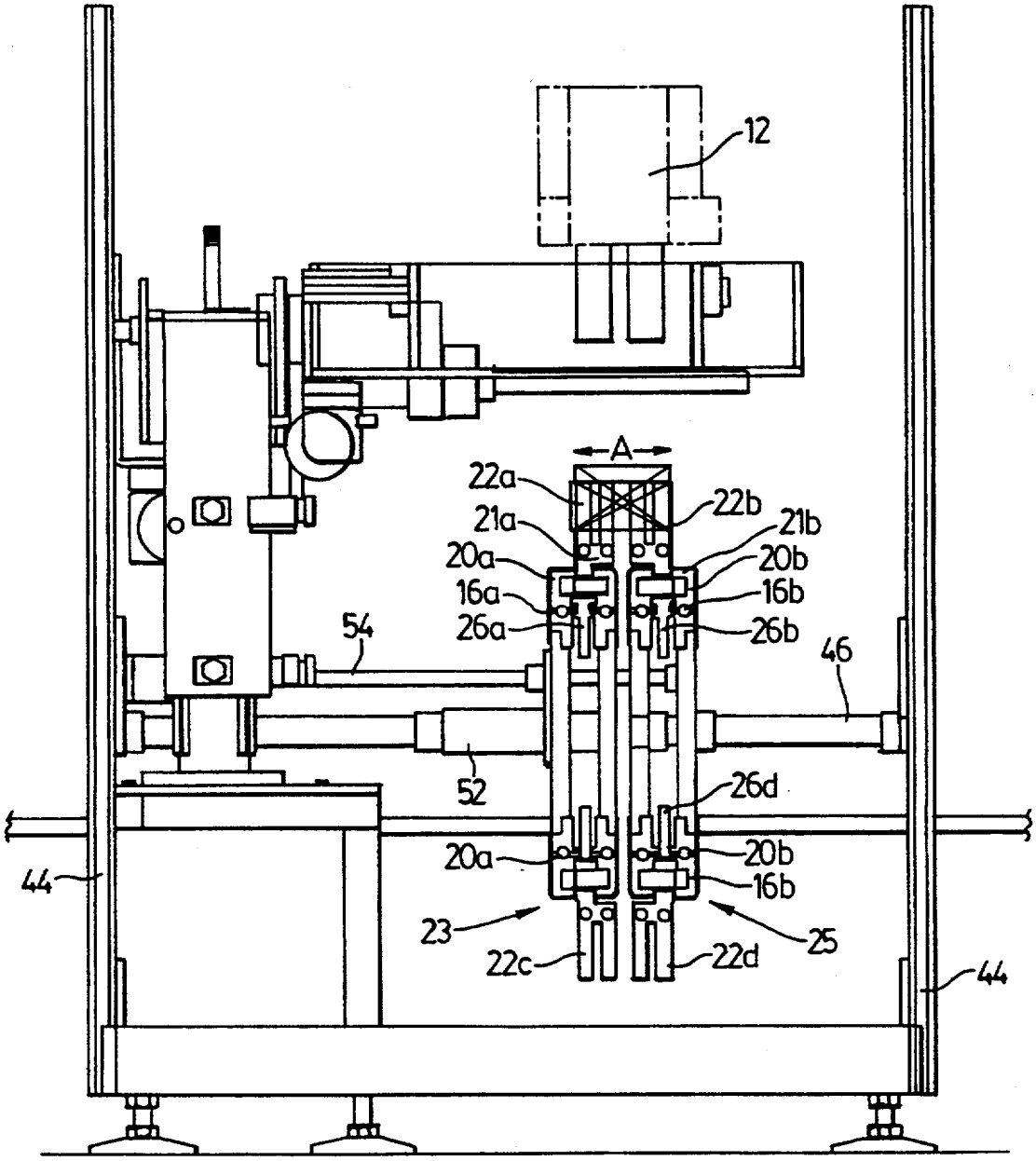
FIG. 3 is an enlarged end view of the system shown in FIG. 1.

As shown in FIGS. 3 and 6, the components of the carton loading system are supported by a frame generally referred to as 44. A supporting rod 46 is mounted transversely of frame 44 and the supporting rod supports a pair of carton carrier support tracks 23, 25. Track 23 has a pair of spaced apart parallel rails **20*a*,21*a* each rail being a channelled member having longitudinal channels oriented inwardly. Likewise track 25 has a pair of spaced apart parallel rails 20*b*,21*b* each rail being a channelled member having longitudinal channels oriented inwardly. Wheels 40*a*,42*a* and 40*b*,42*b* are received within the respective channels of rails 20*a*,21*a* and 20*b*,21*b* and are movable therein. Thus the carton carriers 22*a*, 22*b* are retained within the support tracks 23,25** respectively but movable along the length thereof.

Supported in close proximity to track 23 is a first continuous conveyor **16*a* comprising a pair of parallel running conventional link chains 48*a*,50*a* which between them support an engaging element (in this embodiment a cam follower). Likewise in close proximity to track 25 is a second continuous conveyor 16*b* also comprising a pair of parallel running conventional link chains 48*b*,50*b* which also support between them an engaging element. The continuous conveyors 16*a*,16*b* are driven by drive sprockets 80,82 and are arranged parallel to each other and are driven by sprockets 80,82** in the same direction.

Track 25 is supported by and fixed relative to a plurality of support rods 46. Track 23 is supported on sleeves 52 each of which is slidably mounted on and supported by a plurality of support rods 46. Movement of sleeves 52 on support rods 46 permits the spacing between tracks 23 and 25 to be varied. Thus the spacing between carton carriers **22*a* and 22*b* and between carton carriers 22*c* and 22*d* can be varied to accommodate cartons 12 of varied depth A. An adjustable jack device 54 is adapted to move track 23 to different positions on support rod 46** and also to provide stability and rigidity for the structure.

As shown in FIG. 1, conveyor 16 has a first path segment shown as x, corresponding to a carton receiving station, a second path segment y1 which corresponds with a product loading station 56, and a third path segment y2 corresponding to a second carton loading station 58 and a fourth path segment shown as z which corresponds to the carton discharge station 60. Both conveyors **16*a* and 16*b* shown in FIGS. 3 and 6 have paths corresponding to the path segments of the conveyor 16 illustrated in FIG. 1**.

Figure 5:
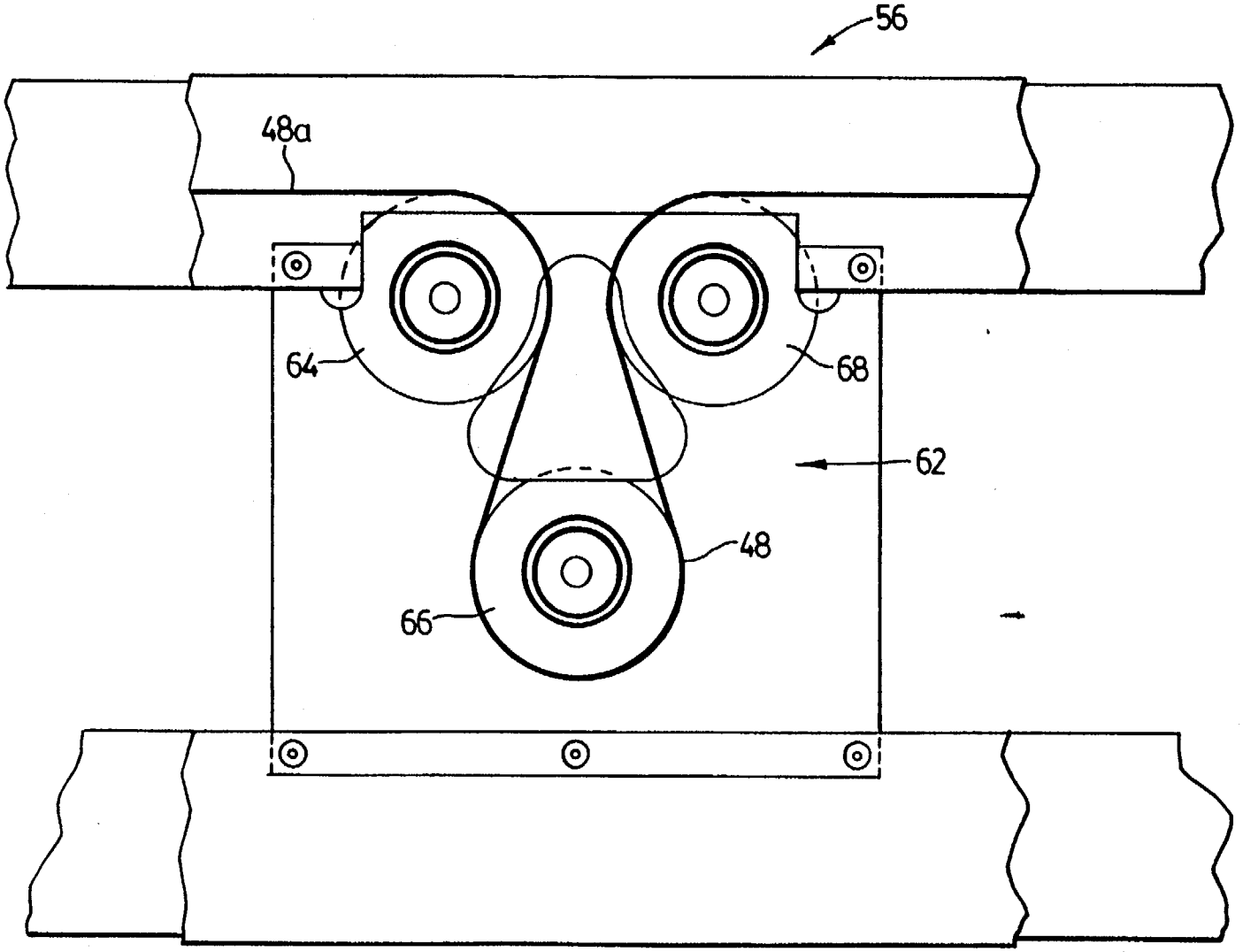
FIG. 5 is a schematic side view of a carton loading station in accordance with an embodiment of the invention.

As shown in FIG. 5 in more detail, at station 56 (and likewise at station 58) there are guide means generally referred to as 62 for each of the link chains 48 and 50. As shown in FIG. 5, chain 48 follows a path defined by the arrangement of three freely rotating journalled sprockets 64, 66 and 68. In the disclosed embodiment, each of the chains **48*a*, 48*b*, 50*a*, 50*b* (FIGS. 3 and 6) have paths corresponding paths defined by a corresponding set of three sprockets to that of chain 48 and sprockets 64,66,68 (FIG. 5). Thus, as chains 48*a*,50*a* and 48*b*,50*b* (FIGS. 3 and 6) are driven at the same speed, each cam follower (not shown) that is carried between chains 48*a*,50*a* and between 48*b*,50*b*** on a path corresponding to that of the chains.

At station 60 which corresponds with path segment z is located a conventional continuous carton discharge apparatus designated generally at 61. The discharge apparatus is adapted to discharge cartons laterally from the carton carriers as the carton carriers move along the carrier support tracks.

In the operation of this system, carton carriers 22 are driven along the carrier support tracks 23, 25. As shown in FIG. 3, carton carriers **22*a*,22*b* are in alignment to receive a carton in one of the openings 23. Each carton carrier 22 is driven by an engaging element 18 which is engagement with the cam members 26**.

As carton carrier 22 moves through path segment x, a carton stored in the magazine 12 is retrieved from the magazine by the carton transfer device 14 and a carton is erected and placed into one of the carton receptacles 91,93 of a pair of aligned carton carriers *22a,22b*. This operation takes place while carton carriers *22a,22b* are in continuously in motion, driven by the engaging elements 18 (cam followers) carried by the continuous conveyors *16a,16b* which are in engagement with slots 32 as engaging elements move along the first path segment x.

Carton carriers *22a,22b* are driven along tracks 23, 25 as the engaging elements 18 move through path segment x to path segment y1. At a first portion of path segment y1, the links 51 of the chains supporting the engaging elements 18 pass over an arc of the circumference of sprockets 64, and the engaging elements 18 move from a position of engagement with the cam members 26, to a position of disengagement from cam members 26, as the engaging elements 18 are carried by chains 48,50 on a circular path about sprocket 64. Although engaging elements 18 have a velocity with a magnitude equal to the speed of the chains 48,50 the direction of movement of the engaging elements is tangential to the circumference of the sprockets 64. Thus the direction of movement of the engaging elements changes as they are carried about an arc on the circumference of the sprocket. At a certain point in its movement, the velocity of the engaging elements 18 will be perpendicular to that part of the track upon which the carton carriers are positioned and the engaging elements will be moving vertically down the slot 32 to eventually disengage from the slot. Once the engaging elements have disengaged from the slot the carton carriers *22a,22b* will be left stationary on the tracks 23,25 at the product loading station 56. Thereafter engaging elements 18 follow a path as the chain links 51 that support them are carried around an arc of sprockets 66 back up towards sprockets 68. During this period of disengagement from engaging elements 18 the carton carriers *22a,22b* are stationary and this will permit the loading of product or other items (for example, inserts) into the carton(s) carried in the receptacles. Thereafter, the movement of the conveyors along path segment y1 will start to move through a second portion where the engaging elements will move to a position to engage cam members 26 as the chain links 51 supporting the engaging elements pass over an arc of the circumference of sprockets 68. Thus, cam members 26 will be engaged by engaging elements 18 and thereafter engaging elements 18 will drive the carton carriers *22a,22b* away from station 56. The carton carriers *22a,22b* will remain in alignment with each other so that the carton will continue to be retained by the carriers.

Thereafter carton carriers *22a,22b* will be driven to a second station 58 wherein the same sequence of events that occurs at station 56 happens, as the engaging elements are carried through path segment y2. This permits the carton carriers *22a,22b* to be stopped and remain stationary for a period of time at the station 58 to allow further operations to occur.

Thereafter, carton carriers *22a,22b* are driven to carton discharge station 60 as the engaging elements are carried by continuous conveyors *16a,16b* through path segment z. At station 60 the carton(s) will be discharged on-the-fly by the carton discharge device 61 (not shown in detail) from the carton carriers *22a,22b*.

An extended magazine 100 is shown in FIG. 1, the purpose of which is to provide a further supply of cartons for the magazine 12.

The carton loading system shown has a product loader *56a* which can be any conventional product loading device. However the system can be adapted to utilize a product loading device such as a continuous loading conveyor having a device which accommodates variations in conveyor movement during unloading of product into a carton. One device which could be modified to deliver product to a carton at station 56 is a carton loading machine having a load accumulator such as that disclosed in U.S. Pat. No. 5,018,334 which issued to Guttinger et al. on May 28, 1991, the contents of which are hereby incorporated fully by reference. This device might also alternatively be positioned at station 58 to provide a loader *58a*, permitting alternate functions to be performed at station 56.

Various other modifications and variations are possible. For example, it is not necessary in many applications to provide that the spacing between tracks 23,25 be adjustable.

Also, it would be possible to join two or more carton carriers in series on the same carrier support track to form a carton carrier train. In this embodiment, not all and preferably only one of the carton carriers in the train on the carrier support track would have an engageable means. Thus engagement of the engageable means of one carrier in the train by one engaging element would drive the entire carton carrier train along the track. Each one of the carton carriers in the carton carrier train might be detachable from the train so that the length of each of the carton carrier trains can be varied. In the two conveyor system and carrier support system described above, one could provide for corresponding trains on each of the carrier support tracks.

We claim:

1. A carton loading system comprising:

a carton carrier support track adapted to support a carton carrier, said carton carrier movable along said carrier support track, said carton carrier being adapted to receive a carton, and said carton carrier having an engageable means associated therewith;

a continuous conveyor carrying at least one engaging element downstream, said engaging element adapted to engage the engageable means of a carton carrier to drive the carton carrier along the carton carrier support track, said continuous conveyor having a conveyor path with a first path segment and a second path segment located downstream of said first path segment, said first path segment being such that an engaging element of said at least one engaging element is carried in engagement with said engageable means in order to drive the carton carrier along the carrier support track, a first portion of said second path segment being such that said engaging element is carried from a position of engagement with said engageable means to a position of disengagement from said engageable means such that said carton carrier may be stopped for a period of time along said carrier support track, a second portion of said second path segment located downstream from said first portion being such that an engaging element of said at least one engaging element is carried to a position of engagement such that the carton carrier may again be driven along the carrier support track;

a carton storage means for storing a plurality of cartons;

a carton transfer means located in operational proximity of salad first path segment for transferring continuously a carton from said carton storage means onto said carton carrier, while said carton carrier is being driven along said carrier support track by an engaging element of said at least one engaging element carried by said continuous conveyor;

a product loading means in operational proximity of said second path segment for loading a product into a carton carried by said carton carrier when said carton carrier is at a stationary position;

in operation, said continuous conveyor first carrying an engaging element of said at least one engaging element along said first path segment, said engaging element being in engagement with said engageable means and driving said carton carrier along said carrier track and said carton transfer means transferring a carton to a moving carton carrier as said engaging element moves along said first path segment, said continuous conveyor thereafter carrying an engaging element of said at least one engaging element in engagement with said engageable means, from said first path segment to said second path segment whereby said carton carrier is driven further along said carrier track, thereafter said continuous conveyor carrying said engaging element along said first portion of said second path segment from a position of engagement with said engageable means to a position of disengagement from said engageable means such that said carton carrier is stopped at said stationary position for a period of time on said carrier track to permit said product loading means to load said product into said carton carried by said carton carrier; thereafter said continuous conveyor carrying an engaging element of said at least one engaging element along said second portion of said second path segment to a position of engagement with said engageable means to drive said carton carrier again along said carrier support track.

2. A system as claimed in claim 1 wherein said continuous conveyor has a third path segment located downstream of said second path segment, said third path segment being such that an engaging element of said at least one engaging element is carried in engagement with said engageable means to drive the carton carrier along the carrier support track, said system further comprising a carton discharge means for discharging said carton from said carton carrier while said continuous conveyor moves said engaging element along said third path segment such that said engaging element is engaged with said engageable means and is driving said carton carrier along said carrier support track.

3. A system as claimed in claim 1 wherein said product loading means comprises a loading conveyor having a loading station and an unloading station, and including means to accommodate variations in loading conveyor movement during loading of product into said carton, said loading conveyor adapted to be stopped at said unloading station to permit loading of product into said carton carried by said carton carrier when said carton is at said stationary position at a carton loading station.

4. A carton loading system as claimed in claim 1 wherein said carton carrier remains stationary at a carton loading station and wherein product loading means comprises a variable capacity load accumulator comprising:

(i) a load transfer conveyor having load transporting compartments at spaced internals along the length thereof, (ii) an input station in which a single load transporting compartment is located, (iii) a discharge station in which a group of at least one longitudinally spaced load transporting compartments is located, (iv) a forward run which extends from the input station to the discharge station and a return run extending from the discharge station to the input station, (v) first and second conveyor drive means located proximate the input station and the discharge station respectively and operable to independently drive or arrest the movement of the forward run through the load transfer station and through the input station;

said variable capacity load accumulator being located between the infeed conveyor and said carton loading station with said input station arranged to admit load items into each of said single load transporting compartments in turn as successive compartments are located in said input station, and with said discharge station located with at least one load transporting compartment opening into said carton loading station, and a transfer means mounted for movement between the discharge station and said carton loading station and operable to transfer load items from the at least one load transporting compartment located in said discharge station into said carton loading station to load a carton located therein carried by a carton carrier in use.

5. A system as claimed in claim 1 wherein said carton carrier comprises a body and said engageable means comprises a cam member depending downwardly therefrom, and further comprising a pair of receptacle walls extending upwardly therefrom to form a carton receptacle for receiving a carton, at least one of said receptacle walls being adjustable to vary the width of said carton receptacle.

6. A system as claimed in claim 1 further comprising a further carton carrier support track running generally parallel to said carton carrier support track, said further carton carrier support track being adapted to support a further carton carrier, said further carton carrier movable along said further carrier support track, said further carton carrier being adapted to receive a carton, said carton carrier and said further carton carrier co-operating and being aligned so that said carton transfer means transfers continuously a carton from said carton storage means onto said carton carrier and said further carton carrier such that said carton is supported therebetween, said further carton carrier having an engageable means associated therewith;

a further continuous conveyor carrying at least one engaging element, said further continuous conveyor adapted to engage the engageable means of said further carton carrier to drive the further carton carrier along the further carton carrier support track, said further continuous conveyor having a conveyor path with a first path segment and a second path segment, said first path segment being such that an engaging element of said at least one engaging element is carried in engagement with said engageable means in order to drive the further carton carrier along the carrier support track, a first portion of said second path segment being such that said engaging element is carried from a position of engagement with said engageable means to a position of disengagement from said engageable means such that said further carton carrier may be stopped for a period of time along said further carrier support track, a second portion of said second path segment located downstream from said first portion being such that an engaging element of said at least one engaging element is carried to a further position of engagement such that the further carton carrier may again be driven along the further carrier support track; said further continuous conveyor driving said further carton carrier along said further support track such that the motion of said further carton carrier is synchronized with the motion of said carton carrier, whereby said carton carrier and said further carton carrier move in unison and said carton is supported between said carton carrier and said further carton carrier.

7. A carton loading system as claimed in claim 6 further comprising means to adjust the longitudinal spacing of said further carrier support track relative to said carrier support track, for adjusting the spacing between said carton carrier and said further carton to selectively accommodate cartons of different depths therebetween.

8. A carton loading system as claimed in claim 7 further comprising means to adjust the longitudinal spacing of said further continuous conveyor relative to said continuous conveyor whereby adjustments corresponding to the adjustments of said carrier track and said further carrier track can be made.

9. A carton loading system comprising:

first and second carton carrier support tracks each adapted to support first and second carton carriers respectively, each said first and second carton carriers movable along their respective carrier support track, said first and second carton carriers being aligned on their respective support tracks and being adapted to receive a carton and to permit loading of a carton to be supported by said first and second carton carriers, said first and second carton carriers each having an engageable means associated therewith;

a first continuous conveyor carrying at least one engaging element downstream, said engaging element adapted to engage the engageable means of said first carton carrier to drive said first carton carrier along the first carton carrier support track, said first continuous conveyor having a conveyor path with a first path segment and a second path segment located downstream of said first path segment, said first path segment being such that an engaging element of said at least one engaging element is carried in engagement with said engageable means in order to drive the first carton carrier along the first carrier support track, a first portion of said second path segment being such that said engaging element is carried from a position of engagement with said engageable means to a position of disengagement from said engageable means such that said first carton carrier may be stopped for a period of time along said first carrier support track, a second portion of said second path segment located downstream from said first portion being such that an engaging element of said at least one engaging element is carried to a position of engagement such that the first carton carrier may again be driven along the first carrier support track;

a second continuous conveyor moving at the same speed as said first continuous conveyor and carrying at least one engaging element downstream, said engaging element adapted to engage the engageable means of said second carton carrier to drive said second carton carrier along the second carton carrier support track in synchronization with the movement of said first carton carrier along said first carton carrier support track, said second continuous conveyor having a conveyor path with a first path segment and a second path segment located downstream of said first path segment, said first path segment being such that an engaging element of said at least one engaging element is carried in engagement with said engageable means in order to drive the second carton carrier along the second carrier support track, a first portion of said second path segment being such that said engaging element is carried from a position of engagement with said engageable means to a position of disengagement from said engageable means such that said second carton carrier may be stopped for a period of time along said second carrier support track that corresponds with the period of time that the first carton carrier may be stopped along the first carton carrier support track; a second portion of said second path segment of said second continuous conveyor path located downstream from said first portion being such that an engaging element of said at least one engaging element is carried to a position of engagement such that the second carton carrier may again be driven along the second carrier support track in synchronization with the movement of the first carton carrier along the first carton carrier support track;

a carton storage means for storing a plurality of cartons;

a carton transfer means located proximate said first path segments of said first and second continuous conveyors for transferring continuously a carton from said carton storage means onto said first and second carton carriers, while said first and second carton carriers are being driven respectively along said first and second carrier support tracks by engaging elements of said at least one engaging element carried by said first and second continuous conveyors;

a product loading means at said second path segment for loading a product into a carton carried by said first and second carton carrier when said first and second carton carriers are at a stationary position;

in operation, said first and second continuous conveyors first each carrying engaging element of said at least one engaging element along said first path segments, said engaging elements being in engagement with said engageable means of said first and second carton carrier and driving said first and second carton carriers in synchronization along said first and second carrier tracks respectively and said carton transfer means transferring a carton to moving first and second carton carriers as said engaging elements move along said first path segments, said first and second continuous conveyors thereafter each carrying an engaging element of said at least one engaging element in engagement with said engageable means of said first and second carton carriers, from said first path segment to said second path segment whereby said first and second carton carriers are driven further along said first and second carrier tracks, said first and second continuous conveyors moving said engaging elements along said first portions of said second path segment and carrying said engaging elements from positions of engagement with said engageable means of said first and second carton carriers to positions of disengagement from said engageable means of said first and second carton carriers such that said first and second carton carriers are stopped at said stationary position for a period of time on said first and second carrier tracks to permit said product loading means to load said product into said carton carried by said first and second carton carriers, thereafter said first and second continuous conveyors each carrying an engaging element of said at least one engaging element along said second portions of said second path segments to a further position of engagement with said engageable means of said first and second carton carriers to drive said first and second carton carriers again in synchronization along said first and second carrier support tracks.

* * * * *

UNITED STATES PATENT AND TRADEMARK OFFICE

CERTIFICATE OF CORRECTION

PATENT NO. : 5,371,995

DATED : December 13, 1994

INVENTOR(S) : Peter Guttinger, Istvan Ungar

It is certified that error appears in the above-indentified patent and that said Letters Patent is hereby corrected as shown below:

IN THE CLAIMS

Claim 1, column 9 line 6 after "of" cancel "salad" and insert --said--.

Signed and Sealed this

Twentieth Day of August, 1996

Bruce Lehman

*Attest:*

BRUCE LEHMAN

*Attesting Officer*

*Commissioner of Patents and Trademarks*